US010758094B2

(12) United States Patent
Peteri

(10) Patent No.: US 10,758,094 B2
(45) Date of Patent: Sep. 1, 2020

(54) SOAP PUMP

(75) Inventor: Niels Theodoor Peteri, Rotterdam (NL)

(73) Assignee: Henri Peteri Beheer B.V., Ridderkerk (NL)

( * ) Notice: Subject to any disclaimer, the term of this patent is extended or adjusted under 35 U.S.C. 154(b) by 0 days.

(21) Appl. No.: 14/345,121

(22) PCT Filed: Sep. 12, 2012

(86) PCT No.: PCT/EP2012/067874
§ 371 (c)(1),
(2), (4) Date: Mar. 14, 2014

(87) PCT Pub. No.: WO2013/037851
PCT Pub. Date: Mar. 21, 2013

(65) Prior Publication Data

US 2014/0332566 A1 Nov. 13, 2014

(30) Foreign Application Priority Data

Sep. 17, 2011 (NL) ..... 1039048

(51) Int. Cl.
*A47K 5/12* (2006.01)
*B05B 11/00* (2006.01)

(52) U.S. Cl.
CPC ..... *A47K 5/1211* (2013.01); *A47K 5/1205* (2013.01); *B05B 11/3045* (2013.01); *A47K 2005/1218* (2013.01)

(58) Field of Classification Search
CPC ..... A47K 5/1211; A47K 5/1205; A47K 2005/1218; B05B 11/3045; B05B 11/0027; B05B 11/3001
(Continued)

(56) References Cited

U.S. PATENT DOCUMENTS 2,885,125 A * 5/1959 Russell ..... B05B 11/0013 222/180
3,216,624 A * 11/1965 Corsette ..... B05B 11/3007 222/321.9
(Continued)

FOREIGN PATENT DOCUMENTS

CN 1695047 A 11/2005
CN 1780784 A 5/2006
(Continued)

OTHER PUBLICATIONS

Search Report and Written Report from corresponding foreign application PCT/EP2012/067874, filed Sep. 12, 2012.
(Continued)

*Primary Examiner* — Paul R Durand
*Assistant Examiner* — Robert K Nichols, II
(74) *Attorney, Agent, or Firm* — Steven M. Koehler; Westman, Champlin & Koehler, P.A.

(57) ABSTRACT

A hand pump for fixing to a working surface comprises a pump housing and an outlet that extends substantially laterally with respect to the pump housing in order to extend above a receptacle. The pump is operable by substantially straight-lined operational movement of the outlet along the pump housing. The outlet and the pump housing are coupled by a guide, in particular comprising a guide in the pump housing that inhibits tilting of the outlet with respect to the pump housing.

20 Claims, 5 Drawing Sheets

(58) Field of Classification Search
USPC ..... 222/383.1, 321.7, 180, 173, 182, 321.9
See application file for complete search history.

(56) References Cited

U.S. PATENT DOCUMENTS

| | | | | |
|---|---|---|---|---|
| 3,422,996 | A * | 1/1969 | Lipman | B05B 11/3059 222/384 |
| 4,420,096 | A * | 12/1983 | Kirk, Jr. | B05B 11/3059 222/321.9 |
| 4,817,829 | A * | 4/1989 | Fuchs | B05B 11/0051 141/27 |
| 5,148,948 | A * | 9/1992 | Granville | A47K 5/12 222/153.09 |
| 5,405,060 | A * | 4/1995 | von Schuckmann | 222/325 |
| 5,441,178 | A * | 8/1995 | Wysocki | B05B 11/0027 222/182 |
| 5,476,197 | A * | 12/1995 | Lawrence et al. | 222/321.7 |
| 5,598,954 | A * | 2/1997 | Salzano | 222/162 |
| 6,644,516 | B1 | 11/2003 | Foster | |
| 6,695,171 | B2 * | 2/2004 | Walters | B05B 11/3001 222/153.13 |
| 6,923,346 | B2 | 8/2005 | Foster | |
| 2005/0155988 | A1 | 7/2005 | Meehan | |
| 2010/0034680 | A1 * | 2/2010 | Arnold | 418/1 |

FOREIGN PATENT DOCUMENTS

| | | | |
|---|---|---|---|
| CN | 201675836 | U | 12/2010 |
| EP | 0442058 | A2 | 8/1991 |
| FR | 407288 | | 2/1910 |
| GB | 2085531 | | 4/1982 |

OTHER PUBLICATIONS

Office Action for related Chinese application No. 201280044491.9, dated Dec. 2, 2015.

Taiwanese Office Action for Taiwanese patent application No. 101133854, dated Aug. 25, 2016.

* cited by examiner

SOAP PUMP

CROSS-REFERENCE TO RELATED APPLICATION

This application is a Section 371 National Stage Application of International Application PCT/EP2012/067874 filed Sep. 12, 2012 and published as WO 2013/037851 A1 in English.

BACKGROUND

The discussion below is merely provided for general background information and is not intended to be used as an aid in determining the scope of the claimed subject matter.

Aspects of the present invention relate to a hand pump for attachment to a working surface near a sink, comprising a pump housing and an outlet extending substantially laterally from the pump housing in order to reach above a receptacle.

Such pumps are known, in particular as soap pump for application in kitchens and/or sanitary facilities wherein the receptacle may be a sink or wash basin and the working surface may be a part of the sink or wash basin.

Such known soap pumps comprise an operating button that usually needs to be pushed substantially vertically with respect to a substantially horizontal working surface. The button and the outlet are usually integrated. The outlet of such pumps is relatively long, in order to be able to bridge a sufficiently long distance on the one hand to fix the pump sufficiently firm to the working surface, in particular extending through the working surface, and on the other hand to allow the outlet to extend above the sink, to make it possible to collect liquid flowing out of the outlet when this is not being collected in another manner, such as for instance in the palm of a hand.

As a result of this length, the operation of the pump requires using two hands: one hand for the operation of the button and the other hand for the collection of the soap. In case of an attempt to use only one hand, it is possible to operate the operating button but impossible to collect the dispensed soap, or, when the outlet itself is pressed upon, it is impossible to exert a pushing force on the pump mechanism effectively, it is possible that parts of the mechanism wedge and/or is it possible that the outlet is bent or even broken.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background It is therefore desired to have an improved pump of the aforementioned type.

For this purpose such a pump is provided, which is operable by substantially straight-lined movement of the outlet along the pump housing, wherein the outlet and the pump housing are coupled by a guide, in particular comprising guidance means in the pump housing, against tilting of the outlet with respect to the pump housing.

This guide facilitates the straight-lined movement of the outlet with respect to the pump housing, as a result of which wedging and/or slanting of parts of the pump operation mechanism are prevented and it becomes possible to effectively exert an operational force. Thus the operation is possible by pushing on or near the outflow end of the outlet and by that single handed operation of the pump.

The pump housing may be fixed substantially perpendicular on the working surface and thus be oriented substantially vertical. In such a case the operating direction is also substantially vertical. The outlet may extend substantially horizontal. The outlet may be substantially straight or comprise one or more bends.

In an embodiment the guide is provided with one or more bearings. As a result, friction between moving parts is avoided or at least reduced, and thus the operation is facilitated and the risk of damage is reduced.

In an embodiment the outlet is fixed to a plunger arranged inside the pump housing, wherein the plunger and the pump housing are mutually connected through the guide.

The plunger may extend substantially in the operating direction of the pump and have guidance means at or near either side in the operating direction, that cooperate with guiding means of the pump housing for establishing the guide.

A part of such cooperating guiding means may comprise one or more of the aforementioned bearings, and a part of the cooperating guiding means may comprise surfaces of guiding grooves and/or ribs that serve as treads for the bearings.

The pump housing may partly comprise the outlet, wherein the pump housing may be provided with an opening through which the outlet extends and wherein the outlet is movable. The opening may have the shape of an elongated hole or groove, and this may prevent a rotational movement of the outlet with respect to the pump housing and the direction of movement, at a substantially vertical orientation of the pump housing and the direction of movement a substantially horizontal turning movement may thus be prevented. Further moving parts may thus be enclosed and covered by such a pump housing, which may yield a robust pump and allows for a relatively free design of the pump. Further, the pump may rest directly on the working surface and no ridges or sealings are needed at the outside of the pump, whereby also a hygienic, installation is obtained.

The pump may be provided by a coupling, that may for instance be provided with a screw thread, for mounting to the working surface, for example thereon and/or there through. The coupling may for example comprise a mounting tube extending through the working surface and optionally provided with a screw thread or another provision for mounting to the working surface.

The pump may be provided with a coupling, for example a screw coupling, for coupling to a liquid reservoir, for instance of a refill package.

The pump may be provided with a pressure container for building up pressure, which pressure container may be separate from a possible liquid reservoir. The pressure container may be arranged for metering of a dispensing amount and/or a predetermined dispensing amount.

A part of the pump may be arranged for the accommodation of a pump unit that may be exchangeable, for example for maintenance or replacement.

The pump may be arranged such that the pump housing with the outlet can be separated from the working surface, in particular may be drawn out of the mounting tube that may be mounted in the working surface. This allows for the refilling of the liquid reservoir and/or if necessary the replacement of the pump unit accommodated in the pump housing, from the user side of the working surface, in this case from above.

BRIEF DESCRIPTION OF THE DRAWINGS

These and other aspects will hereafter be explained in more detail, referring to the accompanying drawings that show an embodiment by means of illustration only, not necessarily on scale and wherein parts not necessary for an understanding of the invention may have been removed. In the drawings.

DETAILED DESCRIPTION

Figure 1:
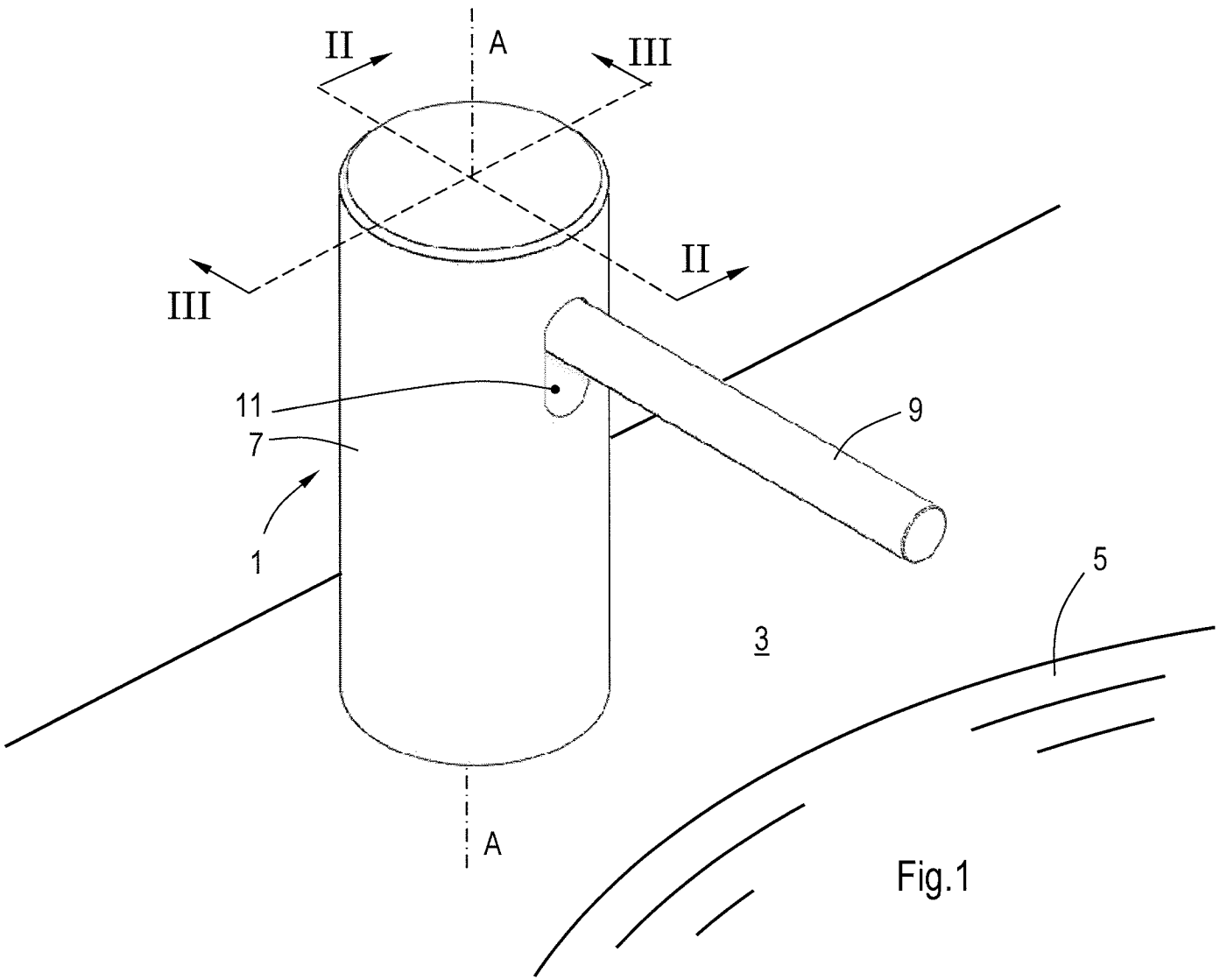
FIG. 1 shows a view in perspective of an improved hand pump.

The Figures show a hand pump formed as a soap pump 1 for use in domestic kitchens. The hand pump 1 is fixed to a working surface 3 near a receptacle 5 formed as a sink 6 and comprises a pump housing 7 and an outlet 9 extending substantially laterally with respect to the pump housing 7 in order to extend above the receptacle 5. The pump housing 7 is in this case substantially cylindrical in an axial direction A.

The pump 1 can be operated by a substantially straight-lined operating movement of the outlet 9 along the pump housing 7 in the axial direction A. The outlet 9 and the pump housing 7 are coupled with a guide for preventing tilting of the outlet 9 with respect to the pump housing 7, as is explained into more detail below.

The pump 1 is distinguished from the existing pumps by the operation of the pump via the outlet 9. This takes away the need for a push button on top of the pump housing 7. The pump 1 allows—in contrast to the known soap pumps—for operation by one hand, by grasping the outlet 9, pushing this downward and catching the soap in the same hand. The direction of movement of the outlet 9 with respect to the pump housing 7 is also determined by an elongated hole 11 through which the outlet 9 extends and in which the latter is movable.

Figure 2:
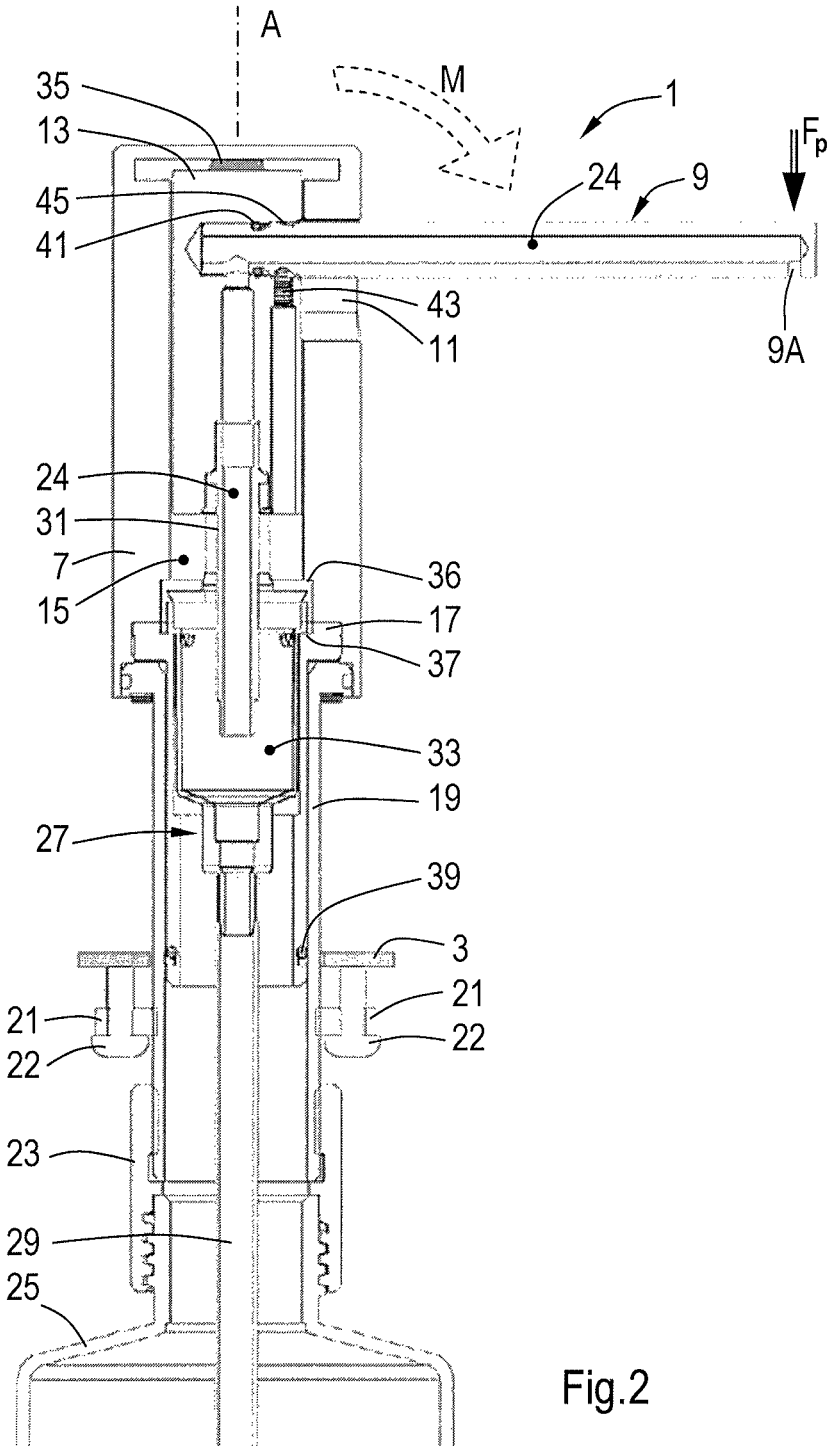
FIG. 2 shows a cross sectional view of an improved hand pump as indicated by II-II in FIG. 1.
Figure 3:
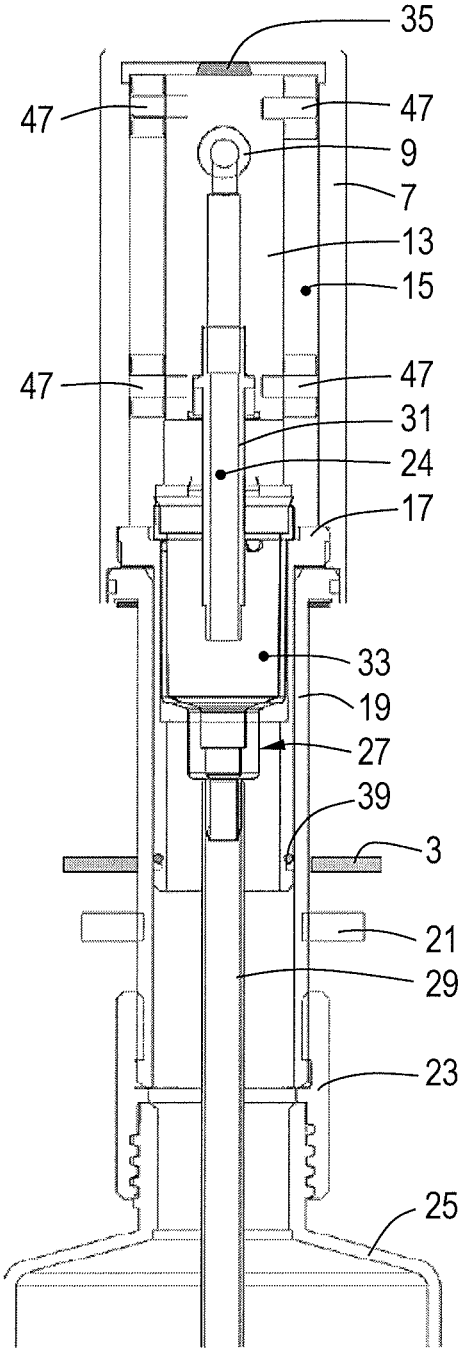
FIG. 3 shows a cross sectional view of an improved hand pump as indicated by III-III in FIG. 1.

FIGS. 2 and 3 show the pump into more detail and in cross sections along the axis A in substantially mutually perpendicular directions.

The Figures show the pump housing 7 and the outlet 9 with exit 9A, that is attached to a plunger 13 which is movable in a lumen 15 of the pump housing 7 in an axial direction A. The pump further comprises a lock-up bush 17 and a mounting tube 19. A lock-up nut 21 with adjusting screws 22 is mounted to the mounting tube 19. Further a coupling 23 is fixed to the mounting tube 19, to which a soap reservoir 25 for liquid hand soap, for example cream soap, is fixed (shown only partially).

The pump 1 comprises a pump unit 27 known per se that comprises a suction tube 29, a pressure tube 31 and a pump chamber 33 with valves (not shown) and springs (not shown). The pressure tube 31 is connected via the plunger 13 to (the exit 9*a* of) the outlet 9 such that an uninterrupted channel 24 is formed. The pressure tube 31 extends partially in the pump chamber 33 and is provided there with a piston (not shown). By pushing down the pressure tube 31 and the piston, in the provided pump 1 by movement of the outlet 9 and the plunger 13, a valve to the suction tube 29 is closed in the pump chamber with as a result that pressure is built up on the liquid present in the pump chamber 33. As a result a valve to the pressure tube 31 is opened and the liquid is allowed to flow through the pressure tube 31 and the channel 24 and be delivered from the outlet. After the movement has ended the piston of the press tube 31, and as a result the plunger 13 and the outlet 9, is pushed upward again by means of a pressure spring, resulting in the closing of the valve to the pressure tube 31 and the opening of the valve to the suction tube by the under pressure created in the pump chamber and a new amount of liquid is sucked into the pump chamber 33 and the original situation is restored. An impulse against the pump housing 7 of the plunger 13 at the end of the return movement may be caught by a buffer, in this case an elastic plug 35, for example made of (artificial) rubber.

The pump chamber 33 is accommodated fixedly in the pump 1 by clamping it between shoulders 36, 37 of the pump house 7 and the lock up bush 17. By pushing down the outlet 9 with respect to the pump house 7, the pump unit 27 is operated via the plunger 13.

By means of the lock up bush 17 provided with an O-ring 39, or by any other suitable fastener, the entire operating part of the pump 1 (pump housing 7, outlet 9, plunger 13, lock up bush 17, pump unit 27, etc) is slid accurately fitting into the opening of the mounting tube 19 until it is on the working surface 3. Here the outer edge of the pump housing 7 covers the ring of the mounting tube 19, as a result of which the latter is invisible. In this manner, a stable positioning of the pump 1 on the working surface 3 is obtained without a screwed joint or another kind of fixed connection between pump 1 and working surface. A fixing system and/or a further coupling between the operational part of the pump 1 and the mounting bush 19 and/or the working surface 3 may nevertheless be provided, if desired.

In the shown embodiment, the outlet 9 is fixed to the plunger 13 in a releasable manner, here provided with an O-ring 41 and fixed by a setting screw 42 in the plunger that extends into a tapered groove 45 in the outlet 9. For the realization of a stable pumping operation in a pump 1, it thus is necessary to exert a vertical force Fp (indicated by an arrow in FIG. 2) on the pump unit 27 known per se from the (end of) the outlet 9.

Figure 4:
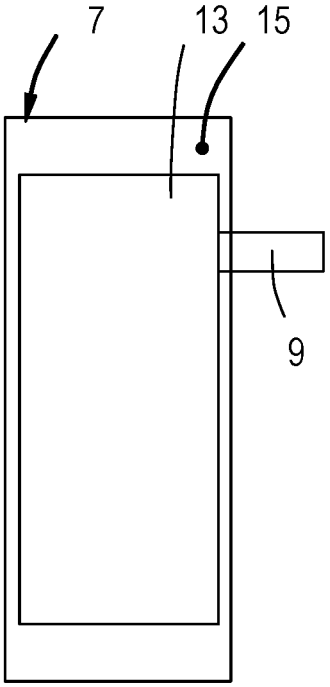
FIG. 4 shows a cross sectional view of a plunger in a pump housing at a hypothetical hand pump without a guide.
Figure 5:
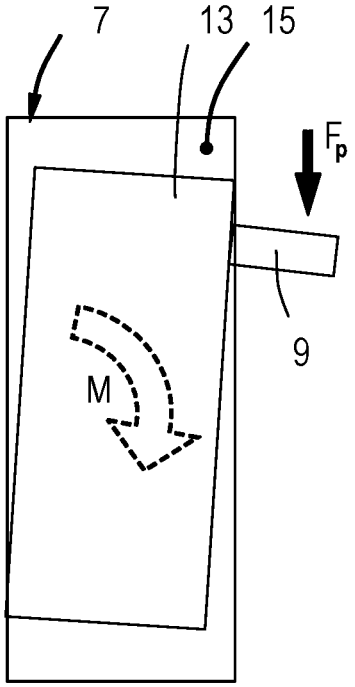
FIG. 5 shows the slanting of the plunger in the pump housing at (an attempt to operate) the hand pump of FIG. 4.

Because the downwardly directed force does not operate on the axis of the pump unit 27 (in this case coinciding with the axis A), a moment M arises, indicated by the dotted arrow in FIG. 2, causing lateral reaction forces between plunger 13 and pump housing 7. These reaction forces cause the plunger 13 to slant within the lumen 15 of the pump housing 7, which causes additional friction, see FIGS. 4-5.

Figure 8:
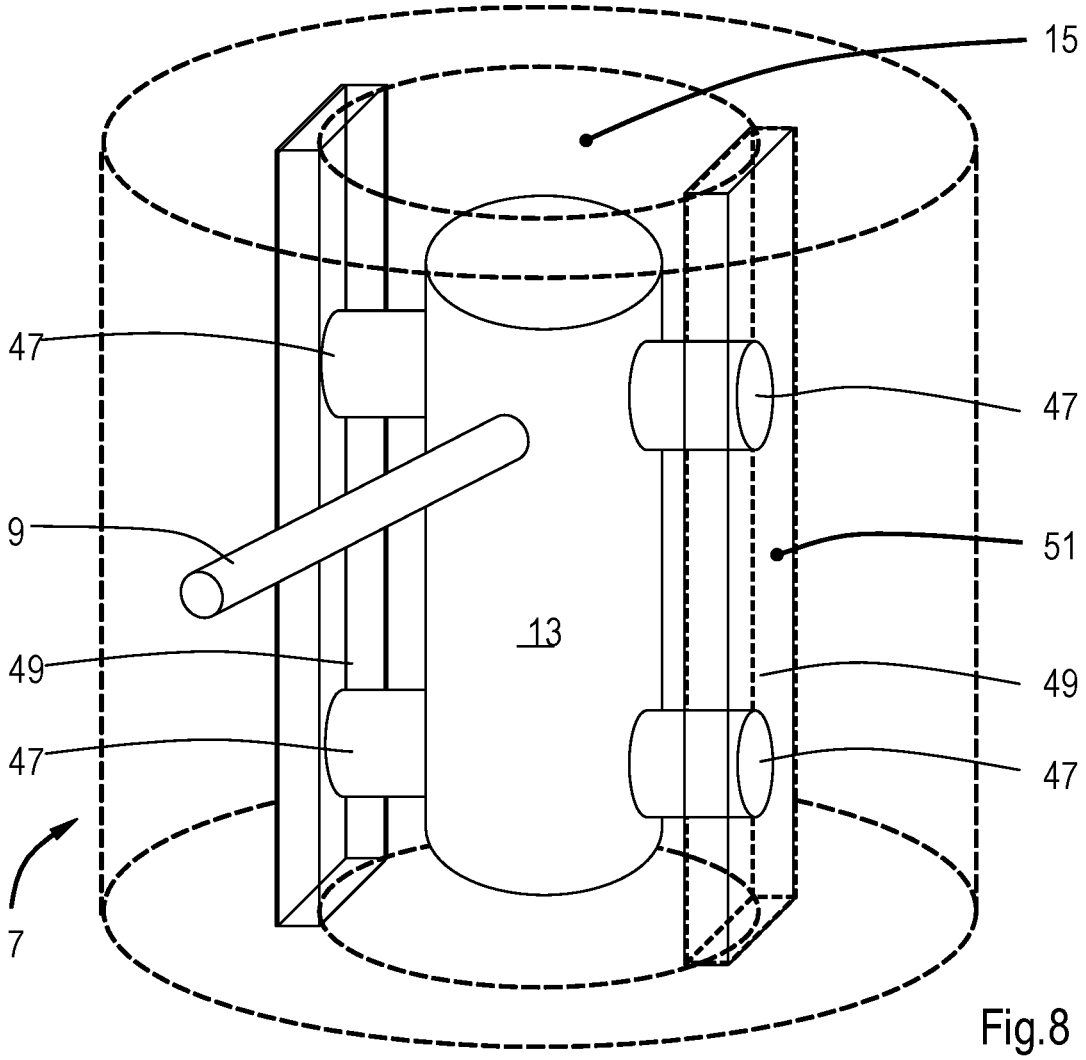
FIG. 8 shows schematically a drawing in perspective of the improved hand pump according to FIGS. 1-3, 6-7.

The friction caused by the slanting thus needs to be taken away, in order to obtain appropriate operation. This is realized in the provided pump 1 by providing the pump housing 7 with guiding means preventing tilting of the outlet 9 and the plunger 13 with respect to the pump housing 7. The guiding means comprise bearings 47 arranged at either side of the plunger 13 and at either side in the direction of operation along A of the plunger 13, in other words at the top and at the bottom sides thereof. The bearings 47 are arranged as rollers on guiding surfaces 49 provided in the pump housing 7, for example by milling away two guiding tracks 51, opposing each other in a plane substantially perpendicular to the reaction forces that cause the slanting, thus in this case substantially perpendicular to the extension direction of the outlet 9 (shown schematically in FIG. 8).

Figure 6:
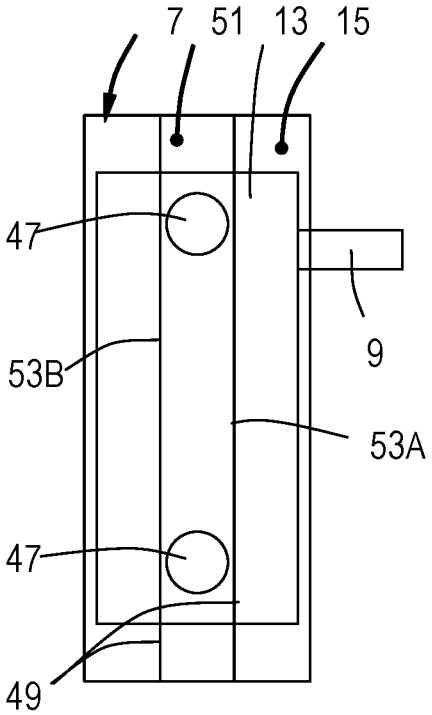
FIG. 6 shows schematically an improved hand pump with a guide as in FIGS. 1-3.
Figure 7:
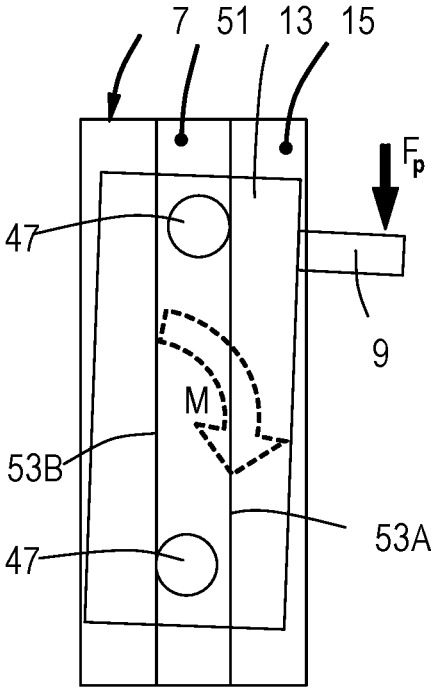
FIG. 7 shows operation of the pump of FIG. 6.

In the preferred embodiment, the plunger 13 is provided with two pairs of ball bearings 47, one pair at the top of the plunger 13 and one pair at the bottom side (FIGS. 3, 6-7). The upper pair of ball bearings 47 will, at the exertion of a pressing force Fp on the outlet 9 for pressing the pump run against a wall 53A of guiding track 51 on the side of the outlet, and the lower bearings will run against the opposing wall 53B of the guiding track 51, preventing further tilting and slanting, as a result of which the plunger is further held from slanting contact with the (inner wall of) the pump housing 7. By preventing contact of one bearing 47 with both walls 53A, 53B simultaneously, friction is avoided and an easy rolling movement is made possible, requiring only a minimal amount of play between bearings and guiding walls, which contributes to a stable pumping operation without an additional force being necessary to overcome friction.

The invention is not limited to the embodiments described above, but may also be realized in various other manners within the scope of the attached claims. There may for instance be provided more and/or differently shaped guides, such as more rollers, or sliding surface made of a slippery material such as polytetrafluoretheen (PTFE, "Teflon®"). Instead of the plunger, the pump housing may be provided with bearings.

The pump housing may have a substantially rectangular cross section, and contain one or more grooves.

It is possible to provide more than one outlet and/or plunger in the pump housing. The outlet may be fixed to a carriage that is movably coupled to the pump housing in a guide, instead of a plunger.

It is further noted that, within the scope of the claims, elements and aspects of one or more different embodiments may be left away and/or combined, unless explicitly stated otherwise.

The invention claimed is:

1. A hand pump for fixing to a working surface, comprising:

a pump housing;

an outlet that extends substantially laterally from the pump housing, having a laterally extending portion with an outflow end remote from the pump housing;

a pump unit at least partially enclosed by the pump housing and extending in an axial direction of the pump housing, the pump unit comprising a pump chamber, a pressure tube, and a piston in the pump chamber, and the pump unit being operable by moving the laterally extending portion of the outlet in a substantially straight-lined operational movement of the outlet by pushing the laterally extending portion on or near the outflow end, wherein the laterally extending portion of the outlet moves along a surface of the pump housing extending in the axial direction;

a plunger arranged in the pump housing, the plunger connecting the pump unit with the outlet, and the plunger being fixed to the outlet to move therewith; and a guide having cooperating first and second guide elements in the pump housing connecting the plunger and the pump housing, wherein the first guide element extends in the axial direction and the second guide element extends laterally with respect to the axial direction; and wherein the guide is provided with one or more rollers.

2. The hand pump according to claim 1, wherein the second guide element comprises a roller and the first guide element comprises guiding surfaces of guiding grooves and/or ribs.

3. The hand pump according to claim 1, wherein the hand pump includes a liquid reservoir configured to be filled from a user side of the working surface and/or from a top side.

4. The hand pump according to claim 1, further comprising a reservoir coupling configured to connect a portion of the hand pump to a liquid reservoir.

5. A hand pump for fixing to a working surface, comprising:

a pump housing which is provided with a lateral opening;

a coupling configured to fix the hand pump to the working surface;

an outlet partly enclosed by the pump housing which pump housing thus forms an axial and lateral cover over part of the outlet, the outlet extending substantially laterally from the pump housing through the lateral opening in which the outlet is movable, providing an outflow end remote from the pump housing, such that the hand pump is operable by pushing the outlet on or near the outflow end that is outside of and remote from the pump housing;

a pump unit extending in an axial direction of the pump housing, the pump housing enclosing the pump unit and forming an axial and lateral enclosure enveloping the pump unit, and the pump unit being operable by moving the outlet in a substantially straight-lined operational movement of the outlet in the lateral opening in the axial direction by said pushing the outlet on or near the outflow end that is outside of and remote from the pump housing; and a structure in the pump housing having a first guide element and a second guide element cooperating with the first guide element which connect the outlet and the pump housing, wherein the structure includes a plunger enclosed by the pump housing, the pump housing forming an axial and lateral enclosure enclosing the plunger except for an opening through which the outlet extends, the plunger being movable in the pump housing, the plunger being fixed to the outlet to move therewith such that the hand pump is operable by pushing the outlet on or near the outflow end that is outside of and remote from the pump housing while tilting of the plunger relative to the pump housing is substantially prevented by the structure.

6. The hand pump according to claim 5, wherein the first and second guide elements are complementary being each of size and shape so as to inhibit tilting of the plunger and the outlet with respect to the pump housing at an exertion of a pressing force on the outlet on or near the outflow end and provide substantially straight-lined operational guided movement of the outlet in the lateral opening in the axial direction.

7. The hand pump according to claim 5, wherein the hand pump includes a liquid reservoir configured to be filled from a user side of the working surface and/or from a top side.

8. The hand pump according to claim 5, further comprising a reservoir coupling configured to connect a portion of the hand pump to a liquid reservoir.

9. The hand pump according to claim 5, wherein the first guide element or the second guide element is provided with one or more bearings.

10. The hand pump according to claim 5, wherein the second guide element comprises a bearing and the first guide element comprises surfaces of guiding grooves and/or ribs.

11. A hand pump for fixing to a working surface, comprising:

a pump housing;

a coupling configured to fix the hand pump to the working surface;

an outlet that extends substantially laterally from the pump housing providing an outflow end remote from the pump housing, a pump unit extending in an axial direction, the pump unit comprising a pump chamber, a pressure tube, and a piston in the pump chamber, and wherein the pump unit is operable by substantially straight-lined operational movement of the outlet in the axial direction along the pump housing, caused by a pushing force pushing the outlet on or near the outflow end that is outside of and remote from the pump housing, a plunger connecting the pump unit with the outlet, the plunger being arranged in the pump housing and extending substantially in the axial direction of the pump housing, and the outlet being partially enclosed in the pump housing and fixed to the plunger, the pump housing forming an axial and lateral cover covering a top of the outlet and envelopes the plunger; and a first guide part extending in a substantially lateral direction with respect to the axial direction, the first guide part coupling the plunger and the pump housing below the outlet, and at or near a level of the outlet or above the outlet, and wherein the pump housing substantially prevents access to the plunger.

12. The hand pump according to claim 11, wherein the hand pump includes a liquid reservoir configured to be filled from a user side of the working surface and/or from a top side, and the hand pump further comprising a reservoir coupling configured to connect a portion of the hand pump to the liquid reservoir.

13. The hand pump according to claim 11, wherein the first guide part includes one or more bearings and cooperates with surfaces of guiding grooves and/or ribs.

14. A hand pump comprising:

a coupling configured to fix the hand pump to a working surface;

a pump housing, an outlet that extends substantially laterally from the pump housing, having a laterally extending portion with an outflow end remote from the pump housing, a pump unit at least partially enclosed by the pump housing and extending in an axial direction of the pump housing, the pump unit comprising a pump chamber, a pressure tube, and a piston in the pump chamber, and the pump unit being operable by moving the laterally extending portion of the outlet in a substantially straight-lined operational movement of the outlet by pushing the laterally extending portion on or near the outflow end, wherein the laterally extending portion of the outlet moves along within an elongated hole of the pump housing extending in the axial direction;

a plunger arranged in the pump housing, the plunger connecting the pump unit with the outlet, and the plunger being fixed to the outlet to move therewith; and a guide having cooperating first and second guide elements in the pump housing connecting the plunger and the pump housing to inhibit tilting of the outlet with respect to the pump housing, wherein the first guide element extends in the axial direction and the second guide element extends laterally with respect to the axial direction, wherein seen in the axial direction, the first guide element and the second guide element comprise a first portion arranged below the outlet and a second portion arranged at or near a level of the outlet or above the outlet, and wherein the pump housing has an outside surface being a closed structure except for an opening through which the outlet extends.

15. The hand pump according to claim 14, wherein the hand pump includes a liquid reservoir configured to be filled from a user side of the working surface and/or from a top side, and the hand pump further comprising a reservoir coupling configured to connect a portion of the hand pump to the liquid reservoir.

16. The hand pump according to claim 14, wherein the guide is provided with one or more bearings.

17. The hand pump according to claim 14, wherein the second guide element comprises a bearing and the first guide element comprises surfaces of guiding grooves and/or ribs.

18. The hand pump according to claim 14, wherein the opening in a part of the outside surface of the pump housing extending in the axial direction is an elongated hole through which the outlet extends and in which the outlet is movable.

19. The hand pump according to claim 14, wherein the hand pump includes a liquid reservoir configured to be filled from a user side of the working surface and/or from a top side.

20. The hand pump according to claim 14, and further comprising a reservoir coupling configured to connect a portion of the hand pump to a liquid reservoir.

* * * * *